US007555991B2

(12) United States Patent
Dhellemmes et al.

(10) Patent No.: US 7,555,991 B2
(45) Date of Patent: Jul. 7, 2009

(54) SELF-SUPPORTING TIMBER BOX FOR THE SUPPORT AND THERMAL INSULATION OF AN IMPERMEABLE TANK MEMBRANE

(75) Inventors: Jacques Dhellemmes, Versailles (FR); Gery Canler, Le Pecq (FR)

(73) Assignee: Gaztransport et Technigaz, Saint-Remy-les-Chevreuse (FR)

( * ) Notice: Subject to any disclaimer, the term of this patent is extended or adjusted under 35 U.S.C. 154(b) by 931 days.

(21) Appl. No.: 11/081,749

(22) Filed: Mar. 17, 2005

(65) Prior Publication Data

US 2005/0204665 A1 Sep. 22, 2005

(30) Foreign Application Priority Data

Mar. 17, 2004 (FR) ..... 04 02736

(51) Int. Cl.
*B63B 25/08* (2006.01)

(52) U.S. Cl. ..... 114/74 A; 220/901

(58) Field of Classification Search ..... 114/74 A, 114/74 R, 74 T; 220/560.04, 560.06, 560.07, 220/560.12, 560.15, 901, 902
See application file for complete search history.

(56) References Cited

U.S. PATENT DOCUMENTS 3,785,320 A * 1/1974 Bourgeois et al. ..... 114/74 A
5,269,247 A * 12/1993 Jean ..... 114/74 A
5,586,513 A * 12/1996 Jean et al. ..... 114/74 A
6,035,795 A * 3/2000 Dhellemmes et al. ..... 114/74 A
6,145,690 A * 11/2000 Dhellemmes et al. ..... 220/901
6,199,497 B1 * 3/2001 Dhellemmes et al. ..... 114/74 A
6,374,761 B1 * 4/2002 Dhellemmes ..... 114/74 A

FOREIGN PATENT DOCUMENTS

FR 2 586 082 2/1987
FR 2 629 897 10/1989
FR 2 798 902 3/2001

* cited by examiner

*Primary Examiner*—Lars A Olson
(74) *Attorney, Agent, or Firm*—Young & Thompson

(57) ABSTRACT

Self-supporting timber box having a base panel, lateral walls each projecting perpendicularly from one side of the base panel to delimit the profile of an internal space of the box, a plurality of internal partitions (14) which are parallel to each other and perpendicular to the base panel and which extend between the lateral walls in such a way as to divide the internal space into a plurality of compartments intended to receive a heat-insulating lining, and a cover panel, wherein it has at least one stiffening element (16) which is positioned in the internal space transversely with respect to the internal partitions and which has an area of connection (17, 18) to each of the internal partitions to increase the buckling resistance of the internal partitions, the area of connection extending over a depth greater than or equal to half of the distance between the base and cover panels.

10 Claims, 4 Drawing Sheets

Figure 1:
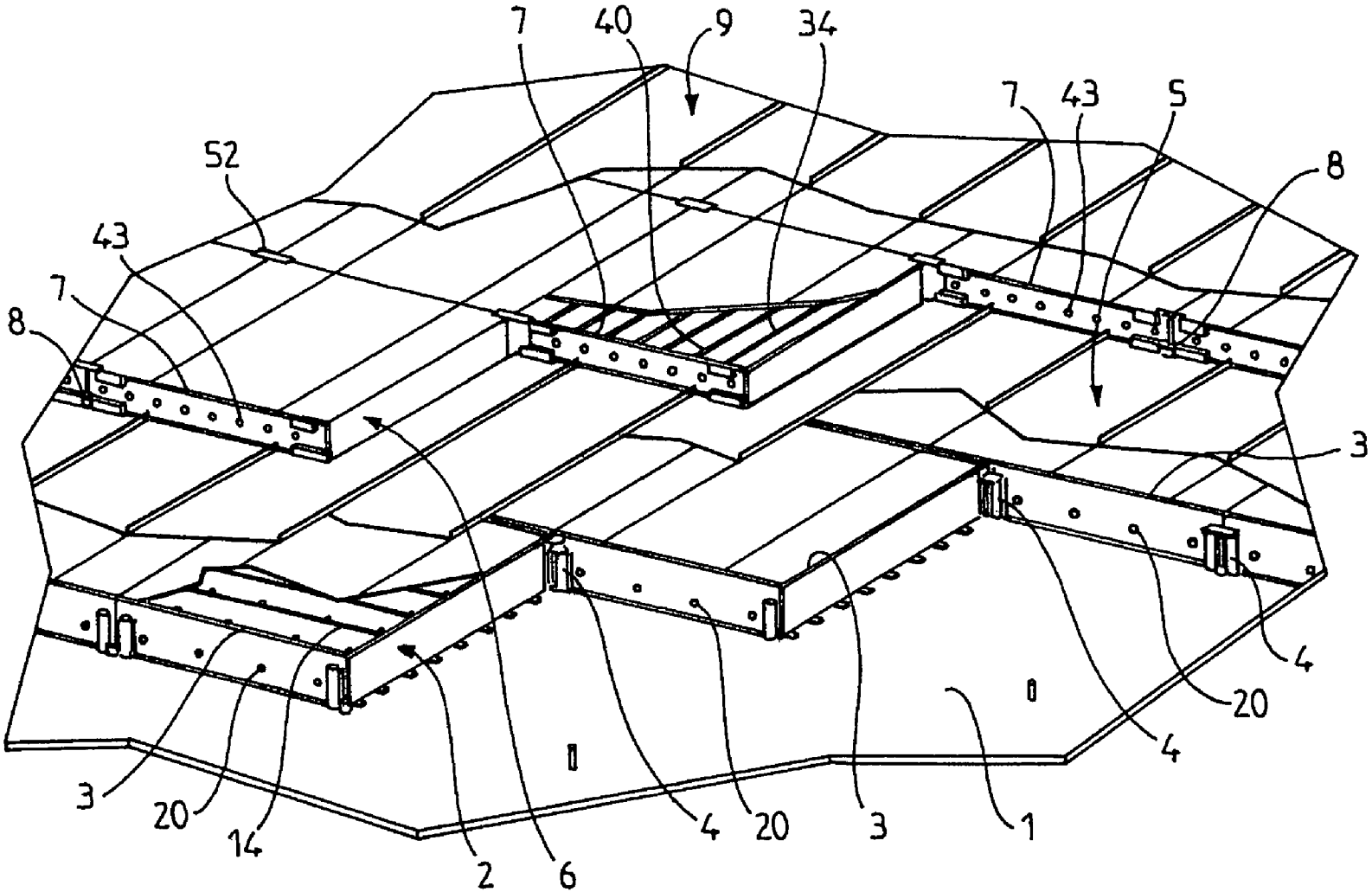

SELF-SUPPORTING TIMBER BOX FOR THE SUPPORT AND THERMAL INSULATION OF AN IMPERMEABLE TANK MEMBRANE

The present invention relates to the technical field of membrane tanks intended to contain a cold liquid and consisting of tank walls supported on the supporting structure of a ship. The invention also relates to self-supporting timber boxes for the support and thermal insulation of the membranes of such tanks.

In the field of the marine transport of liquefied gases, particularly gases with a high methane content, there is a known type of membrane tank intended to contain a cold liquid and consisting of tank walls supported on the supporting structure of a ship, said tank walls including in their thickness, in the direction from the outside to the inside of said tank, a secondary insulating barrier supported on said supporting structure, a secondary impermeable membrane supported on said secondary insulating barrier, a primary insulating barrier supported on said secondary impermeable membrane and a primary impermeable membrane supported on said primary insulating barrier. The documents FR2105710, FR2146612, FR2629897 and FR2683786, among others, describe tanks of this type in which one or both of the insulating barriers are made with the aid of self-supporting timber boxes filled with a heat-insulating lining.

In use, the tank wall boxes are subjected to compressive stresses due to the static pressure and the dynamic impacts of the fluid contained in the tank, the fluid being made to move, in particular, by the rolling and pitching of the ship. The boxes must withstand these stresses over a long service life, given the risks of rupture of the membrane if an underlying box collapses and the costs of the work required to replace a box.

The object of the present invention is to provide a self-supporting timber box for the support and thermal insulation of an impermeable tank membrane which meets these requirements. Another object of the invention is to provide a tank whose service life and reliability are increased.

For this purpose, the invention provides a self-supporting timber box for the support and thermal insulation of an impermeable tank membrane intended to contain a cold liquid, said box comprising a base panel, lateral walls fixed to said base panel and projecting perpendicularly from one side of said base panel to delimit the profile of an internal space of said box, a plurality of internal partitions which are parallel to each other and perpendicular to said base panel and which extend between said lateral walls in such a way as to divide said internal space into a plurality of compartments intended to receive a heat-insulating lining, and a cover panel supported and fixed on an upper edge of said lateral walls and said internal partitions so that it is parallel to said base panel and at a distance therefrom, thus enclosing said internal space of the box, wherein it has at least one stiffening element which is positioned in said internal space transversely with respect to said internal partitions and which has an area of connection to each of said internal partitions to increase the buckling resistance of said internal partitions, said area of connection extending over a depth greater than or equal to half of the distance between said base and cover panels, and preferably greater than or equal to two thirds of the distance between said base and cover panels.

The connection between the stiffening element and each internal partition in a continuous or discontinuous connection area extending in this way enables the buckling stresses to be distributed over the stiffening element and considerably reduces the bending of the internal partition under a given compressive stress.

Advantageously, said stiffening element extends between two opposite lateral walls parallel to said internal partitions, said stiffening element having two ends, each fixed to said lateral walls. Thus the stiffening element connects the internal partitions not only to each other but also to the two opposite lateral walls, which further increases the buckling resistance of the internal partitions.

Preferably, said stiffening element takes the form of a plate perpendicular to said base panel, interacting by fitting with each of said internal partitions in said area of connection. A stiffener in this form also enables the internal partitions to be positioned correctly with respect to each other.

Preferably, said stiffening element has a corresponding notch to receive each of said internal partitions, each of said internal partitions having a notch to receive one portion of said stiffening element located in the extension of said respective corresponding notch of said stiffening element. Thus the area of connection between the stiffening element and an internal partition consists of two adjacent areas defined, respectively, by the notch of the stiffening element receiving the internal partition and by the notch of the internal partition receiving the stiffening element.

Advantageously, the notch of each of said internal partitions is shallower than the respective corresponding notch of said stiffening element. Thus the fitting is achieved without the notch of each of said internal partitions significantly weakening the internal partition with respect to a bending stress parallel to the stiffening element.

In one particular embodiment, said lateral walls and said internal partitions have drilled holes allowing a gas to be circulated through said box, said drilled holes being located closer to said base panel than to said cover panel. This characteristic is intended to keep these drilled holes away from the area of the lateral walls and the internal partitions in which the bending caused by a given compressive stress is greatest. This enhances the buckling resistance of the lateral walls and the internal partitions. Preferably, but not necessarily, said drilled holes are located in a plane parallel to said base and cover panels.

Advantageously, the plane containing said drilled holes cuts said area of connection of the stiffening element with each of said internal partitions, preferably approximately halfway up said area. Thus the drill holes are placed at a level where the reduction of the bending of the partitions by the stiffening element is effective, or even maximal.

Preferably, the box is parallelepipedal in shape, said lateral walls including two opposing walls parallel to the internal partitions and two opposing walls perpendicular to the internal partitions, to which the ends of said internal partitions are fixed. Advantageously, said internal partitions and said lateral walls parallel to said internal partitions are thicker than the lateral walls perpendicular to the internal partitions. The lateral walls perpendicular to the internal partitions are stiffened by said partitions which are fixed to them, so that their thickness and cost can be reduced for any given buckling resistance.

The invention also provides a membrane tank intended to contain a cold liquid and consisting of tank walls supported on the supporting structure of a ship, said tank walls including within their thickness, in the direction from the outside to the inside of said tank, a secondary insulating barrier supported on said supporting structure, a secondary impermeable membrane supported on said secondary insulating barrier, a primary insulating barrier supported on said secondary impermeable membrane and a primary impermeable membrane supported on said primary insulating barrier, wherein said secondary insulating barrier essentially consists of the aforementioned boxes juxtaposed and filled with a heat-insulating lining. The use of these boxes enhances the resistance of the tank wall to the compressive stresses due to the static and dynamic pressure of the fluid contained in the tank, this fluid being subject to movements caused by the swell of the sea.

Advantageously, said primary insulating barrier essentially consists of self-supporting timber boxes juxtaposed and filled with a heat-insulating lining, each of said boxes comprising a base panel, lateral walls fixed to said base panel and projecting perpendicularly from one side of said base panel to delimit the profile of an internal space of said box, at least one internal partition fixed perpendicularly to said base panel and extending between said lateral walls in such a way as to divide said internal space into a plurality of compartments intended to be fitted with a heat-insulating lining, and a cover panel supported and fixed on an upper edge of said lateral walls and of said at least one internal partition parallel to said base panel and at a distance therefrom to enclose said internal space of the box, said cover panel comprising two boards bonded and stapled to each other.

This two board assembly of the cover enhances the bending stiffness of the cover and reduces the sliding of the two boards with respect to each other, thus also enhancing the shear resistance of the cover. In this way the cover is made more resistant to localized stresses, particularly to hydrodynamic impacts caused by the movements of the fluid contained in the tank, both in the compression direction perpendicular to the cover and in the shear direction tangential to the cover.

Preferably, in the boxes forming the primary insulating barrier, a first board of said cover is stapled onto said upper edge of the lateral walls and said at least one internal partition, independently of said second board, which is then bonded and stapled to said first board. The fabrication of the cover in this way avoids the use of long staples which would have to pass through both boards, and this is advantageous because such long staples show a significant deviation during their insertion and therefore have a mediocre fastening efficiency and a high failure rate (when the end of the staple passes to the side of the upper edge into which it should have been inserted).

The invention also provides a self-supporting timber box for the support and thermal insulation of an impermeable tank membrane intended to contain a cold liquid, said box comprising a base panel, lateral walls fixed to said base panel and each projecting perpendicularly from one side of said base panel to delimit the profile of an internal space of said box, at least one internal partition fixed perpendicularly to said base panel and extending between said lateral walls in such a way as to divide said internal space into a plurality of compartments intended to be fitted with a heat-insulating lining, and a cover panel supported and stapled on an upper edge of said lateral walls and of said at least one internal partition parallel to said base panel and at a distance therefrom to enclose said internal space of the box, wherein said cover panel comprises two boards bonded and stapled to each other.

Figure 3:
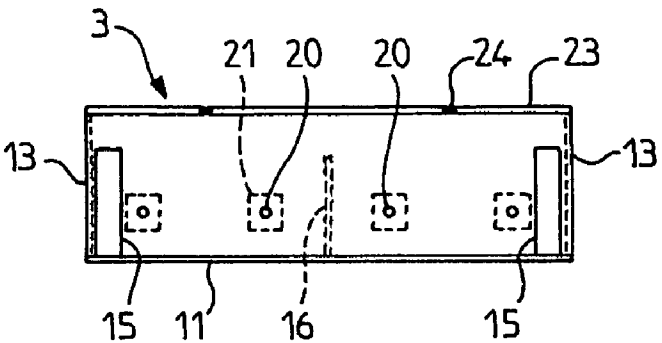
Figure 5:
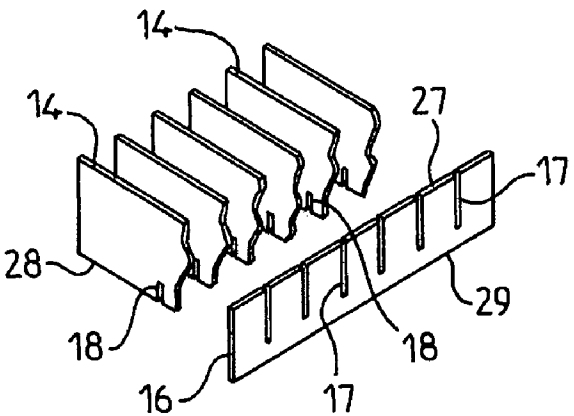
Figure 4:
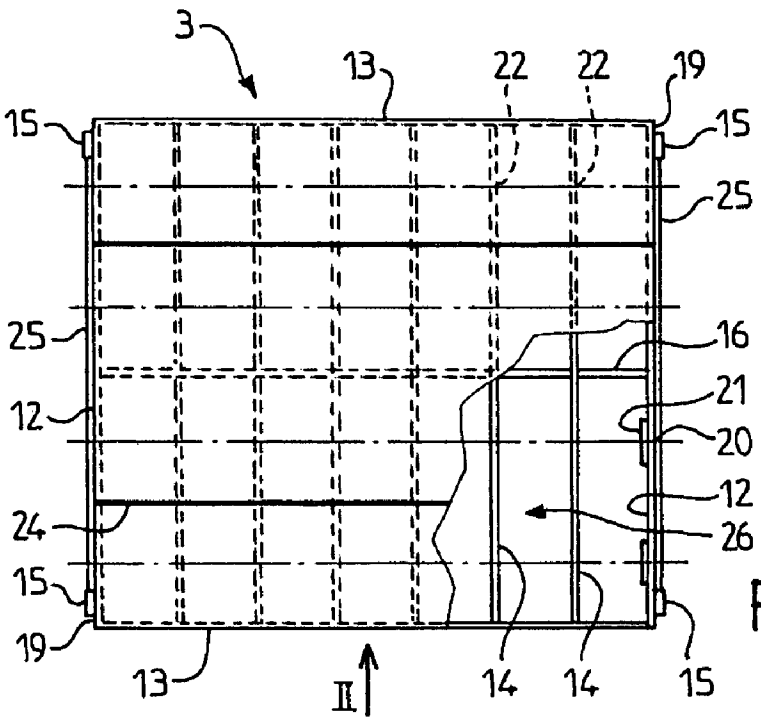
Figure 10:
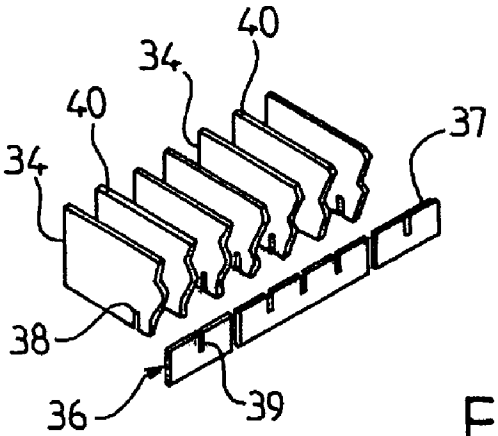
Figure 11:
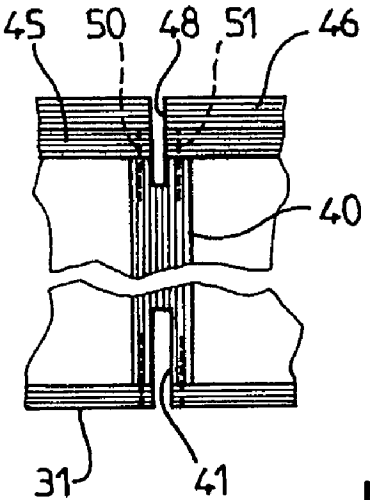
Figure 6:
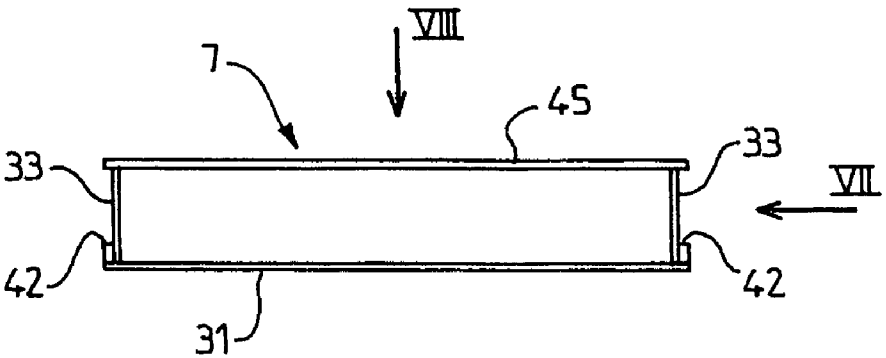
Figure 7:
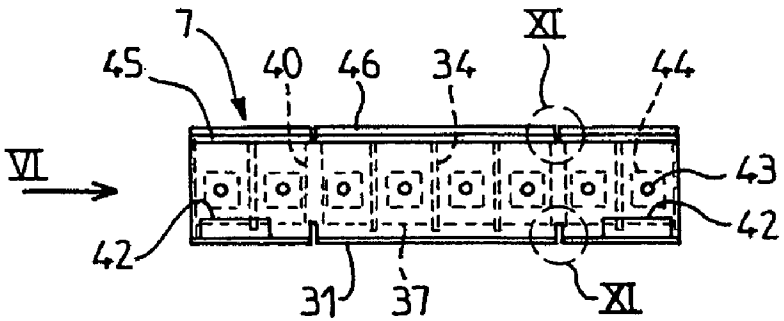
Figure 9:
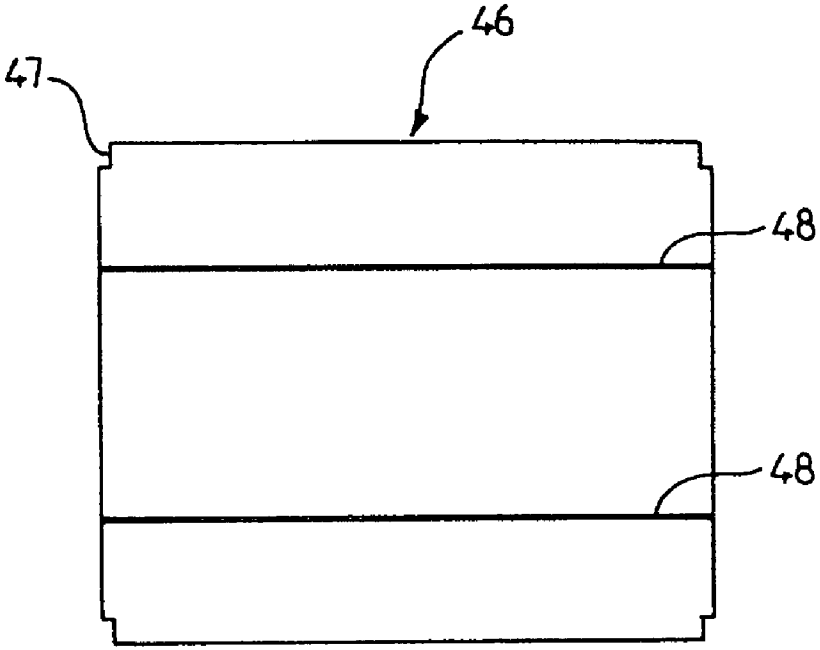
Figure 8:
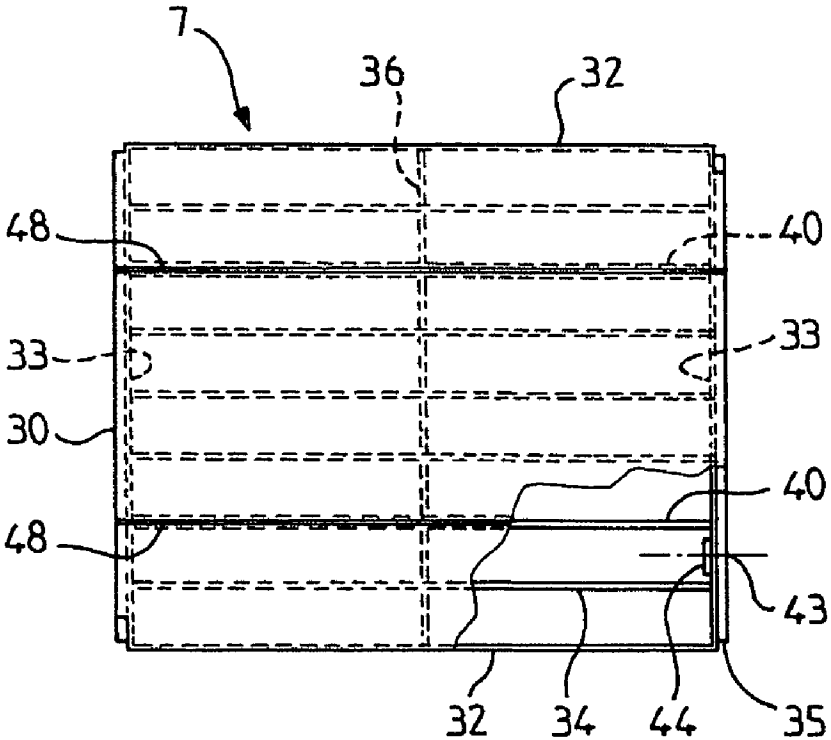

The invention will be made more understandable, and other objects, details, characteristics and advantages thereof will be clarified, by the following description of a particular embodiment of the invention, provided solely for guidance and without restrictive intent, with reference to the attached drawings. In these drawings, FIG. 1 is a partial view of a tank wall with parts removed, according to one embodiment of the invention, FIG. 2 shows a box forming the secondary insulating barrier of the tank of FIG. 1, in a side view in the direction of the arrow II of FIG. 4, FIG. 3 shows the box of FIG. 2 in a side view in the direction of the arrow III, FIG. 4 shows the box of FIG. 2 in a view from above in the direction of the arrow IV, FIG. 5 is a partial exploded perspective view showing the internal partitions and the stiffening frame of the box of FIG. 2, FIG. 6 shows a box forming the primary insulating barrier of the tank of FIG. 1, in a side view in the direction of the arrow VI of FIG. 7, FIG. 7 shows the box of FIG. 6 in a side view in the direction of the arrow VII, FIG. 8 shows the box of FIG. 7 in a view from above in the direction of the arrow VIII, FIG. 9 shows the second board of the cover of the box of FIG. 7, FIG. 10 is a partial exploded perspective view showing the internal partitions and the positioning frame of the box of FIG. 7, FIG. 11 is an enlarged detail view showing the areas XI of FIG. 7 in cross section.

The general structure of a sealed and thermally insulated tank incorporated in and fixed to the double hull of a ship of the methane tanker type is well known and is polyhedral in shape. The present description will therefore be limited to an area of the tank wall, shown in FIG. 1, it being understood that all the tank walls have a similar structure.

Figure 2:
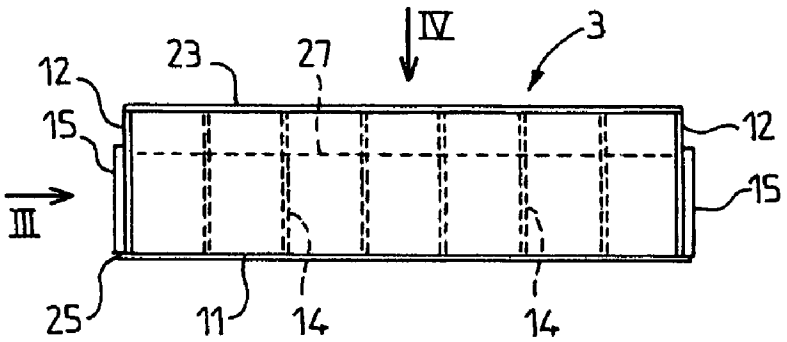

FIG. 1 shows an area of the double hull of the ship indicated by the number 1. The tank wall consists of the following, placed in succession through its thickness: a secondary insulating barrier 2 which is formed by boxes 3 juxtaposed on the double hull 1 and supported thereon by secondary retaining members 4; a secondary impermeable membrane 5 supported by the boxes 3; a primary insulating barrier 6 formed by boxes 7 juxtaposed and supported on the secondary impermeable membrane 5 by primary retaining members 8 which are themselves fixed to the secondary retaining members 4; and finally a primary impermeable membrane 9 supported by the boxes 7.

The membranes 5 and 9 are formed in the same way from a continuous layer of strakes made from steel with a high nickel content, 37% for example, known by the name of Invar, which are welded to form impermeable joints at their lateral edges which are turned up onto parallel welding supports fixed on each occasion to the covers of the boxes 3 and 7 respectively according to the known art.

A box 3 of the secondary insulating barrier 2 will now be described with reference to FIGS. 2 to 5. The box 3 has the general shape of a rectangular parallelepiped, with, for example, a length of 1.2 m, a width of 1 m and a height of 300 mm. It is made from plywood boards which are fastened with staples. The base panel 11 is rectangular in shape, and has small rectangular cut-outs 19 at its four corners to allow the passage of the secondary retaining members 4. Four lateral walls opposing each other in pairs are fixed on the upper side of the base panel 11, these walls consisting of two lateral walls 12 in the direction of the width of the box 3 and two lateral walls 13 in the direction of the length of the box 3. The lateral walls 12 and 13 are fixed perpendicularly to the base panel 11 and assembled in pairs at their ends. The lateral walls 13 run along the corresponding edges of the base panel 11, while the lateral walls 12 are slightly set back from the corresponding edges of the base panel 11, so that the base panel has a flange 25 which projects beyond each lateral wall 12. Two fixing tenons 15 are positioned on each flange 25 and are fastened by bonding and stapling to the outer surface of the lateral walls 12. The fastening tenons 15 act as a bearing surface for the secondary retaining members 4, as described in FR 2,629,897.

In the parallelepipedal internal space 26 of the box 3 surrounded by the lateral walls 12 and 13, a plurality of internal partitions 14, numbering six in the example shown, are positioned, and these extend parallel to the lateral walls 12 between the two opposing lateral walls 13. The internal partitions 14 are stapled to the base panel 11 and also, at their two ends, to the lateral walls 13. The partitions 14 are positioned at regular intervals along the longitudinal direction of the box 3. The internal partitions 14 have the same height as the lateral walls 12 and 13 and thus divide the internal space 26 into identical compartments.

A stiffening frame 16 is positioned perpendicularly to the internal partitions 14, halfway along their length, and extends between the two lateral walls 12 to which it is fastened with staples. At the points of intersection between the internal partitions 14 and the stiffening frame 16, as seen more clearly in FIG. 5, the stiffening frame 16 and the internal partitions 14 are fitted together by means of notches 17 and 18. The notches 17 are formed in the stiffening frame 16 through its upper edge 27 and extend vertically through approximately ¾ of the height of the stiffening frame 16. The notches 18 are formed through the lower edge 28 of the internal partitions 14 and extend through a small height, for example approximately ⅙ of the height of the internal partitions 14. The stiffening frame 16 has a height which is less than that of the partitions 14, being for example between half and two thirds of the height of the partitions 14. When the partitions 14 and the stiffening frame 16 have been fitted together, they interact in an area of connection which corresponds to the sum of the depths of the notches 17 and 18. The depth of the notches 18 corresponds to the distance between the bottom of one notch 17 and the lower edge 29 of the stiffening frame 16, in such a way that the partitions 14 bear fully on the base panel 11 after they have been fitted into the stiffening frame 16.

To enable it to perform its function of thermal insulation, the box 3 is filled with a heat-insulating lining, for example expanded perlite or the like, in particular solid foam materials in a particulate or fibrous form.

To enable an inert gas to be circulated in the secondary insulating barrier 2, the boxes 3 are provided with holes 20 drilled in the lateral walls 12 and holes 22 drilled in the internal partitions 14. As shown in FIG. 4, the drilled holes 20 and 22 are positioned along a plurality of longitudinal lines parallel to the base panel 11 to form the same number of gas circulation passages. To avoid leakage of heat-insulating lining through the holes 20, particularly when the lining is made from a particulate material, a fiberglass mat 21 is bonded on the inner surface of the lateral walls 12 over the holes 20 to form gas-permeable plugs.

The drilled holes 20 and 22 are located in a horizontal plane and inevitably weaken the buckling resistance of the lateral walls 12 and the internal partitions 14. To minimize this weakening, the drilled holes 20 and 22 are positioned at a level closer to the base panel 11 than to the cover 23 of the box 3. For example, the drilled holes 20 and 22 are approximately one third of the way up the box 3 from the base panel 11. The plane containing the drilled holes 20 and 22 therefore cuts the area of connection between the stiffening frame 16 and the internal partitions 14. Preferably, the level of the drilled holes 20 and 22 is chosen so that it is approximately halfway up the stiffening frame 16.

When the box 3 has been filled with its heat-insulating lining, it is closed by a rectangular cover panel 23, which is stapled to the upper edge of the lateral walls 12 and 13 and of the internal partitions 14, in other words in a plane parallel to the base panel 11. Two L-section or inverted-T-section grooves 24 are formed in the upper surface of the cover panel 23, parallel to the longitudinal direction of the box 3, to receive welding supports for fixing the secondary impermeable membrane 5. The distance between the two grooves 24 corresponds to the width of an Invar strake and the distance between each groove 24 and the adjacent lateral wall 13 corresponds to approximately half of this width. Reference should be made to FR 2 629 897 for details of the retention of the boxes 3 on the double hull 1 and the retention of the membrane 5 on the boxes 3.

Table I shows the dimensions of the elements of the box 3 in a preferred example of embodiment.

TABLE I

| Dimension | (mm) |
|---|---|
| Thickness of the base | 6.5 |
| Thickness of the cover | 12 |
| Thickness of the wall 13 | 9 |
| Thickness of the wall 12 | 12 |
| Thickness of the partition 14 | 12 |
| Thickness of the stiffening frame 16 | 15 |
| Height of the partition 14 | 300 |
| Height of the stiffening frame 16 | 200 |
| Depth of the notch 18 | 51 |
| Depth of the notch 17 | 151 |
| Height of the tenon 15 | 220 |
| Thickness of the tenon 15 | 15 |
| Diameter of the holes 20 and 22 | 20 |

A box 7 of the primary insulating barrier 6 will now be described with reference to FIGS. 6 to 11.

The box 7 has the general shape of a rectangular parallelepiped, with, for example, a length of approximately 1.2 m, a width of approximately 1 m and a height of approximately 200 mm. It comprises a rectangular base panel 31 having a small rectangular cut-out 35 at each of its four corners. The general structure of the box 7 is similar to that of the box 3. The box 7 is also formed from plywood boards assembled by stapling. Four lateral walls are fixed perpendicularly to the upper surface of the base panel 31, in such a way as to surround the internal space of the parallelepipedal box 7. These lateral walls comprise two walls 32 extending along the longitudinal edges of the base panel 31 and two walls 33 extending along the width of the base panel 31 and set back slightly from the corresponding edges. Thus two flanges 30 of the panel 31 are formed, fixing tenons 42 being positioned on these flanges and bonded and stapled to the lateral walls 33. The fixing tenons 42 act as a bearing surface for the primary retaining members 8.

The box 7 comprises parallel internal partitions of two types, namely thin internal partitions 34 and thick internal partitions 40. All these internal partitions are fixed perpendicularly to the base panel 31 and extend parallel to the walls 32 between the two lateral walls 33 to which they are also fixed at their two ends. These internal partitions have the same height as the lateral walls 32 and 33 and thus divide the internal space of the box 7 into identical compartments. These compartments are filled with a heat-insulating lining such as expanded perlite or any other appropriate material.

Optionally, depending on the fabrication method used, a positioning frame 36 can be positioned perpendicularly to the internal partitions 34 and 40 halfway along their lengths. Such a frame is shown in FIGS. 8 and 10 in particular. It consists of three parts and extends between the lateral walls 32 perpendicularly to the base panel 31. At its points of intersection with the thin internal partitions 34, it has notches 39 forming a means of fitting to these partitions which have corresponding notches 38 in the corresponding area. The notch 39 is formed through the upper edge 37 of the positioning frame 36, while the notch 38 is formed through the lower edge of the internal partition 34. The positioning frame 36 is interrupted at the positions of the thick internal partitions 40. The positioning frame 36 has a positioning function only, and therefore does not have to be particularly high, as shown in FIG. 7.

In FIG. 1, it can be seen that the boxes 7 are positioned with respect to the boxes 3 in such a way that their respective internal partitions are perpendicular to each other, thus providing a better distribution of the pressure stresses which are transmitted by the boxes 7 to the boxes 3. Provision is made to circulate an inert gas in the primary insulating barrier 6 as in the secondary insulating barrier 2, and in the same direction. For this purpose, holes 43 are drilled in the lateral walls 33 of the box 7 and a gas-permeable plug 44 of fiberglass mat is bonded over each drilled hole 43 on the internal surface of the wall 33 to prevent leakage of granular lining.

It can also be seen in FIG. 1 that the upturned edges of the strakes forming the secondary impermeable membrane 5 and the corresponding welding supports project through the bottom of the boxes 7 along lines parallel to the longitudinal direction of the boxes 7. To house these projecting portions of the secondary impermeable membrane 5, the thick partitions 40 are positioned along the same lines and a notch 41 is formed through the base panel 31 and the lower edge of the internal partition 40, as shown in FIG. 11. The welding supports for fixing the primary impermeable membrane 9 are positioned along the same lines, and corresponding notches 48 are formed in the cover of the box 7 for this purpose.

To optimize the bending stiffness of the box 7, its cover is formed from two separate boards which are fastened together. A first board 45 is placed and stapled on the upper edge of the lateral walls 32 and 33 and the internal partitions 34 and 40, parallel to the base panel 31. At the positions of the thick internal partitions 40, the board 45 has two longitudinal rows of staples 50 and 51 inserted into it, as shown in FIG. 11. A second board 46 is then fastened to the board 45 by means of a coat of adhesive and staples. The board 46 has rectangular recesses 47 at its four corners, forming spotfaces for housing plates 52, shown in FIG. 1, intended to cover the junction areas at the corners of the boxes 7, to provide a continuous bearing surface for the primary membrane 9. When the double cover 45, 46 has been placed in position and fixed, two longitudinal grooves 48 are formed in it, passing through the boards 46 and 45 and the upper part of each thick partition 40 between the two rows of staples 50 and 51. The grooves 48 are used to fix a welding support to retain the primary impermeable membrane 9. Reference should be made to FR 2 105 710, and in particular to FIG. 7, for the installation of this welding support. Reference may be made to FR 2 527 544 for the construction of the primary retaining members 8.

Table II shows the dimensions of the elements of the box 7 in a preferred embodiment.

TABLE II

| Dimension | (mm) |
|---|---|
| Thickness of the board 45 | 12 |
| Thickness of the board 46 | 12 |
| Thickness of the base 31 | 9 |
| Thickness of the walls 33 | 9 |
| Thickness of the walls 32 | 9 |
| Thickness of the partitions 34 | 12 |
| Thickness of the partitions 40 | 24 |
| Height of the positioning frame 36 | 30 |
| Depth of the notches 38 and 39 | 16 |
| Thickness of the positioning frame 36 | 12 |

Clearly, although the invention has been described with reference to a particular embodiment, it is not restricted in any way by this, and comprises all the technical equivalents of the means described and their combinations where these fall within the scope of the invention.

The invention claimed is:

1. A self-supporting timber box (3) for the support and thermal insulation of an impermeable tank membrane (5) intended to contain a cold liquid, said box comprising a base panel (11), lateral walls (12, 13) fixed to said base panel and projecting perpendicularly from one side of said base panel to delimit the profile of an internal space (26) of said box, a plurality of internal partitions (14) which are parallel to each other and perpendicular to said base panel and which extend between said lateral walls in such a way as to divide said internal space into a plurality of compartments intended to receive a heat-insulating lining, and a cover panel (23) supported and fixed on an upper edge of said lateral walls and said internal partitions so that it is parallel to said base panel and at a distance therefrom, thus enclosing said internal space of the box, wherein said box has at least one stiffening element (16) which is positioned in said internal space transversely with respect to said internal partitions and which has an area of connection (17, 18) to each of said internal partitions to increase the buckling resistance of said internal partitions, said area of connection extending over a depth greater than or equal to half of the distance between said base and cover panels, wherein said stiffening element (16) takes the form of a plate perpendicular to said base panel, interacting by fitting with each of said internal partitions (14) in said area of connection, and wherein said stiffening element has a corresponding notch (17) to receive each of said internal partitions, each of said internal partitions having a notch (18) to receive one portion of said stiffening element located in an extension of said respective corresponding notch of said stiffening element.

2. The box as claimed in claim 1, wherein said area of connection (17, 18) extends over a depth greater than or equal to two thirds of the distance between said base and cover panels.

3. The box as claimed in claim 1, wherein said stiffening element extends between two opposite lateral walls (12) parallel to said internal partitions, said stiffening element having two ends, each fixed to said lateral walls.

4. The box as claimed in claim 1, wherein the notch (18) of each of said internal partitions is shallower than the respective corresponding notch (17) of said stiffening element.

5. The box as claimed in claim 1, wherein said box is parallelepipedal in shape, said lateral walls including two opposing walls (12) parallel to the internal partitions and two opposing walls (13) perpendicular to the internal partitions, to which the ends of said internal partitions are fixed, said internal partitions (14) and said lateral walls parallel to said internal partitions being thicker than the lateral walls perpendicular to the internal partitions.

6. The box as claimed in claim 1, wherein said lateral walls (12) and said internal partitions (14) have drilled holes (20, 22) allowing a gas to be circulated through said box, said drilled holes being located closer to said base panel than to said cover panel in a plane parallel to said base and cover panels.

7. A self-supporting timber box (3) for the support and thermal insulation of an impermeable tank membrane (5) intended to contain a cold liquid, said box comprising a base panel (11), lateral walls (12, 13) fixed to said base panel and projecting perpendicularly from one side of said base panel to delimit the profile of an internal space (26) of said box, a plurality of internal partitions (14) which are parallel to each other and perpendicular to said base panel and which extend between said lateral walls in such a way as to divide said internal space into a plurality of compartments intended to receive a heat-insulating lining, and a cover panel (23) supported and fixed on an upper edge of said lateral walls and said internal partitions so that it is parallel to said base panel and at a distance therefrom, thus enclosing said internal space of the box, wherein said box has at least one stiffening element (16) which is positioned in said internal space transversely with respect to said internal partitions and which has an area of connection (17, 18) to each of said internal partitions to increase the buckling resistance of said internal partitions, said area of connection extending over a depth greater than or equal to half of the distance between said base and cover panels, wherein said lateral walls (12) and said internal partitions (14) have drilled holes (20, 22) allowing a gas to be circulated through said box, said drilled holes being located closer to said base panel than to said cover panel.

8. The box as claimed in claim 7, wherein the plane containing said drilled holes (20, 22) cuts said area of connection (17, 18) of the stiffening element with each of said internal partitions.

9. A membrane tank intended to contain a cold liquid and comprised of tank walls supported on the supporting structure of a ship, said tank walls including within their thickness, in the direction from the outside to the inside of said tank, a secondary insulating barrier (2) supported on said supporting structure (1), a secondary impermeable membrane (5) supported on said secondary insulating barrier, a primary insulating barrier (6) supported on said secondary impermeable membrane and a primary impermeable membrane (9) supported on said primary insulating barrier, wherein said secondary insulating barrier essentially consists of boxes (3) juxtaposed and filled with a heat-insulating lining, each box being a self-supporting timber box (3) for the support and thermal insulation of an impermeable tank membrane (5) intended to contain a cold liquid, said box comprising a base panel (11), lateral walls (12, 13) fixed to said base panel and projecting perpendicularly from one side of said base panel to delimit the profile of an internal space (26) of said box, a plurality of internal partitions (14) which are parallel to each other and perpendicular to said base panel and which extend between said lateral walls in such a way as to divide said internal space into a plurality of compartments intended to receive a heat-insulating lining, and a cover panel (23) supported and fixed on an upper edge of said lateral walls and said internal partitions so that it is parallel to said base panel and at a distance therefrom, thus enclosing said internal space of the box, wherein said box has at least one stiffening element (16) which is positioned in said internal space transversely with respect to said internal partitions and which has an area of connection (17, 18) to each of said internal partitions to increase the buckling resistance of said internal partitions, said area of connection extending over a depth greater than or equal to half of the distance between said base and cover panels wherein said primary insulating barrier (6) essentially consists of self-supporting timber boxes (7) juxtaposed and filled with a heat-insulating lining, each of said boxes comprising a base panel (31), lateral walls (32, 33) fixed to said base panel and projecting perpendicularly from one side of said base panel to delimit the profile of an internal space of said box, at least one internal partition (34) fixed perpendicularly to said base panel and extending between said lateral walls in such a way as to divide said internal space into a plurality of compartments intended to be fitted with a heat-insulating lining, and a cover panel supported and fixed on an upper edge of said lateral walls and of said at least one internal partition parallel to said base panel and at a distance therefrom to enclose said internal space of the box, said cover panel comprising two boards (45, 46) bonded and stapled to each other.

10. The membrane tank as claimed in claim 9, wherein, in the boxes (7) forming the primary insulating barrier (6), a first board (45) of said cover is stapled onto said upper edge of the lateral walls (32, 33) and said at least one internal partition (34), independently of said second board (46), which is then bonded and stapled to said first board.

* * * * *